United States Patent [19]

Murai et al.

[11] Patent Number: 4,938,811

[45] Date of Patent: Jul. 3, 1990

[54] STEEL WIRE FOR A SPRING AND METHOD FOR THE PRODUCTION THEREOF

[75] Inventors: Teruyuki Murai; Hideo Ogita; Seizo Takamuku; Norihisa Matsushima, all of Hyogo, Japan

[73] Assignee: Sumitomo Electric Industries, Ltd., Osaka, Japan

[21] Appl. No.: 262,115

[22] Filed: Oct. 19, 1988

Related U.S. Application Data

[63] Continuation of Ser. No. 220,360, Jul. 15, 1988, abandoned, which is a continuation of Ser. No. 705,166, Feb. 25, 1985, abandoned.

[51] Int. Cl.[5] ..... C21D 9/02

[52] U.S. Cl. ..... 148/12 B; 148/12 R; 148/320

[58] Field of Search ..... 428/606; 148/12 B, 320, 148/12 R

[56] References Cited

U.S. PATENT DOCUMENTS

| | | | |
|---|---|---|---|
| 3,196,052 | 7/1965 | Hann | 148/12 B |
| 3,847,002 | 11/1974 | Suzuki et al. | 148/12 B |
| 4,161,415 | 7/1979 | Van den Sype et al. | 148/12 B |
| 4,174,981 | 11/1979 | Cassell | 148/12 B |
| 4,180,418 | 12/1979 | Pavlitsch et al. | 148/12 B |
| 4,336,081 | 6/1982 | Hijikata et al. | 148/12 B |
| 4,407,683 | 10/1983 | Hijikata et al. | 148/144 |
| 4,483,722 | 11/1984 | Freeman | 148/12 B |
| 4,574,016 | 3/1986 | Yamamoto et al. | 148/144 |
| 4,711,675 | 12/1987 | Yamamoto et al. | 148/144 |
| 4,770,721 | 9/1985 | Yamamoto et al. | 148/144 |

FOREIGN PATENT DOCUMENTS

| | | | |
|---|---|---|---|
| 604308 | 8/1960 | Canada | 148/12 B |
| 2917287 | 11/1979 | Fed. Rep. of Germany | 148/12 B |
| 31118 | 3/1977 | Japan | 148/12 B |
| 24891 | 7/1978 | Japan | 148/12 B |
| 119727 | 9/1981 | Japan | 148/12 B |
| 119728 | 9/1981 | Japan | 148/12 B |
| 73134 | 5/1982 | Japan | 148/12 B |
| 1016 | 1/1983 | Japan | 148/12 B |
| 53626 | 3/1984 | Japan | 148/12 B |
| 96246 | 6/1984 | Japan | 148/12 B |
| 724584 | 3/1980 | U.S.S.R. | 148/12 B |
| 737484 | 6/1980 | U.S.S.R. | 148/12 B |
| 2088258A | 6/1982 | United Kingdom | 148/12 B |

*Primary Examiner*—John J. Zimmerman

*Attorney, Agent, or Firm*—Sughrue, Mion, Zinn, Macpeak & Seas

[57] ABSTRACT

A steel wire, and a method for producing the same, for use in the manufacture of a chassis or suspension automotive spring having a high sag resistance. In accordance with the invention, after a heat treatment is effected, strain is imposed to the steel wire so as to thereby improve the sag resistance. The strain may be imposed either during tempering or at room temperature following tempering.

15 Claims, 3 Drawing Sheets

STEEL WIRE FOR A SPRING AND METHOD FOR THE PRODUCTION THEREOF

This is a continuation of application Ser. No. 07/220,360 filed 7/15/88 now abandoned, which is a continuation of application Ser. No. 705,166 filed 2/25/85 now abandoned.

BACKGROUND OF THE INVENTION

The present invention relates to a steel wire for use in the manufacture of a chassis or suspension spring which has high sag resistance. The invention also relates to a method for producing the same.

Careful consideration is given to such factors as sag resistance, relaxation and the like in producing a steel wire for a suspension spring. (In this specification, the term "sag" is used to mean permanent change of form of a coil spring due to repeated or excess stress, resulting in changes in the free height thereof.) Conventional steel wires of a type which have often been utilized in producing such a spring include those produced in accordance with SUP 6 to 7 and SAE 9254.

With the growing demands in recent years for fuel savings, there has been a need for lightweight automotive vehicles. For these reasons, it is necessary to provide a steel wire which is excellent in sag resistance. More particularly, development of such steel wire permits improvements in design stress, and as a result, more lightweight steel wires may be produced. Attempts have hitherto been made to impart high strength to a steel wire by means of a great variety of heat treatments for the purpose of improving sag resistance. However, if the steel wire is excessively strengthened in such a manner, this results in a decrease of the value of ductility factor such as elongation and reduction of area. Due to such excessive strength, the steel wire is liable to be damaged during processing or use, particularly if there are present fine defects on the surface of the steel wire and internal defects therein.

Under these circumstances, as a result of research, the inventors have succeeded in providing a practical and effective steel wire for springs which improves sag resistance without increasing the strength of the wire.

SUMMARY OF THE INVENTION

The present invention is concerned with an improved steel wire for use in the manufacture of a spring, particularly a suspension spring, wherein, after heat treatment is effected, strain is imposed to the steel wire so as to improve sag resistance. The invention also relates to a method for producing the same.

Such strain may be imposed either in the course of tempering (tempering temperature of 400° to 465° C.), or at the cold after the tempering process. It is to be noted that upon straining at the tempering temperature, the steel wire may further be reheated For instance, such strain may be imposed at the tempering temperature after quenching. Also, it may be imposed while reheating a cold steel wire after quenching and tempering are complete. The strain may be imposed either by a bending roll or by dies or roller dies. It is to be noted that when the strain is imposed by the former, the shape of the steel wire remains unchanged, whereas when imposed by the latter, its shape is changed.

Accordingly, as shown in Tables 1–8 in the Examples set forth herein the residual shear strain in the inventive wire can be reduced by at least 20%, and thus, the inventive spring can endure a higher (approximately 10%) stress than that which is endurable by the test spring manufactured by quenching and tempering alone. Therefore, under the same load conditions, the diameter of the inventive spring can be made smaller (approximately 10%) than that of the test spring so that the weight of the inventive spring can be reduced (by approximately 20%) in comparison with that of the conventional test spring.

DESCRIPTION OF THE PREFERRED EMBODIMENTS

Preferred embodiments of the present invention will now be described in greater detail by way of examples.

Figure 1:
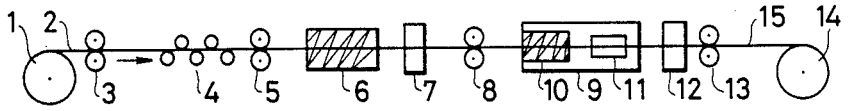
FIG. 1 is a diagrammatic elevational view of a method of producing steel wire according to first and third embodiments of the present invention.

A first embodiment is characterized in that after quenching, tempering is effected while imposing strain to a steel wire, thereby giving a steel wire high sag resistance. FIG. 1 is a diagram illustrating a method for the production thereof.

A steel wire 2 pulled from a supply roll 1 is conveyed in the direction of an arrow by means of a first pair of pinch rolls 3. The steel wire 2 is formed to a linear configuration by means of a reforming unit 4. Thereafter, it is fed to a heating unit 6 by means of a second pair of pinch rolls 5 so as to be heated to an Austenitization temperature for quenching. It will be appreciated that this Austenitization temperature for quenching depends upon the kind of steel employed. When the steel wire 2 is cooled in a cooling unit 7, quenching is completed. Immediately thereafter, the steel wire is fed to a heating unit 10 by which it is heated to a tempering temperature so as to provide the strength required.

An important characteristic of this embodiment is as follows: while the steel wire is heated in the heating unit 10, it is processed by means of a processing unit 11 and at the same time, tempering is effected; immediately thereafter, the steel wire is cooled to atmospheric or room temperature in a cooling unit 12; and it is further conveyed by means of a third pair of pinch rolls 13 and wound on a wire winding roll 14.

It has been found that the steel wire thus produced, generally indicated at 15, is excellent in sag resistance. It will be appreciated that any processing device may be provided in a tempering and processing unit 9 inasmuch as such means may impart strain to the steel wire. The first embodiment will later be illustrated by Examples 1 and 2.

In a second embodiment, tempering is effected while bending the steel wire by means of a bending roll or the like. There may be used a bending roll or rotary bending roll which applies forces in both vertical and transverse directions or only one of the two directions. In addition, any other means may be used to effect bending. The second embodiment will later be illustrated by Example 3.

In accordance with a third embodiment, a die or a roller die is employed in lieu of the processing unit 11, whereby plastic processing may be effected to the steel wire, resulting in a 10 to 30% reduction of area. The third embodiment will later be illustrated by Example 4.

Figure 2:
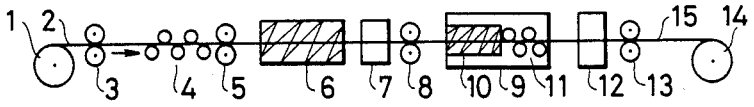
FIG. 2 is a diagram illustrating a method of producing steel wire according to a second embodiment of the invention.

In the preceding embodiments 1 to 3, if the heat treatment is effected under improper processing conditions, excessive strength may undesirably be rendered to the steel wire. Thus, suitable conditions must be determined in such a manner as to achieve only a predetermined strength. Further, processing takes place in the processing unit 11 after the heating is effected in the heating unit 9 as shown in FIGS. 1 and 2. Alternatively, should additional heating be effected after the processing, the same results may be obtained. Still further, if it is necessary to increase the rate of heating, one or more induction heating coils may be provided in the heating units 6 and 10.

A fourth embodiment of the present invention will hereinbelow be described with reference to FIG. 3.

The steel wire 2 pulled from the supply roll 1 is conveyed in the direction of an arrow by means of the first pair of pinch rolls 3 and fed to the heating unit 6 so as to be heated to an Austenitization temperature for quenching determined depending upon the kind of steel employed. It will be appreciated that the steel wire 2 may be formed into a linear configuration by means of a reforming unit prior to the heating process, as in the preceding embodiments. This quenching process is completed when the steel wire 2 is cooled in the cooling unit 7. Thereafter, tensile strain is imposed to the steel wire by means of the units 16 and 17. Under these conditions, the steel wire is heated to a tempering temperature, whereby a predetermined strength is imparted thereto. The steel wire is again cooled in the cooling unit 12 and is finally wound on the wire winding roll 14. It has been found that the steel wire 15 thus produced is excellent in sag resistance.

In this embodiment, the cooling unit 12 is located before the straining unit 17. Alternatively, the cooling unit 12 may be provided behind the straining unit 17. The fourth embodiment of the invention will later be illustrated by Examples 5 and 6. Additionally, according to the present invention, after quenching and tempering are effected, the steel wire may be heated and strained at a temperature below the tempering temperature.

A fifth embodiment of the present invention will now be described with reference to FIG. 4.

The steel wire 2 pulled from the supply roll 1 is conveyed in the direction of an arrow by means of the first pair of rolls 3 and is then formed to a linear configuration by a reforming unit 4. Thereafter, the steel wire is fed to the heating unit 6 by means of the second pair of pinch rolls 5 so as to be heated to an Austenitization temperature for quenching to be determined depending upon the kind of steel employed. This quenching process is completed when the steel wire 2 is cooled in the cooling unit 7. Immediately thereafter, the steel wire is fed to the heating unit 10 by the third pair of pinch rolls 8 and heated to the tempering temperature and then cooled in the cooling unit 11.

An important characteristic of this embodiment is as follows: After quenching and tempering are effected, the steel wire is heated at a temperature below the tempering temperature by means of a heating unit 20, and within the range of such temperature, it is strained by a processing unit 21, the degree of strain imposed by plastifying or reforming being no less than 10%. The steel wire is rapidly cooled to room temperature and wound on the wire winding roll 14. It is found that the steel wire 15 thus produced is excellent in sag resistance. Alternatively, heating, processing and cooling by the heating unit 20, processing unit 21 and cooling unit 12 may be effected in tandem after the preceding quenching and tempering steps. Also, after quenching and tempering are effected once, additional heating and processing may separately be effected. In the heating and processing unit 19 shown in FIG. 4, the processing unit 21 provided before the heating unit 20 so that heating is effected before other processing is carried out. On the other hand, if additional heating is effected after the processing, the same results may be obtained. The fifth embodiment will later be illustrated by Examples 7 and 8.

In a sixth embodiment, as an application of the fifth embodiment, after quenching and tempering are effected, the steel wire is strained under tension, and at the same time, is heated at a temperature below the tempering temperature. Thereafter, it is rapidly cooled. The straining unit to be used in this embodiment can be identical to the one used in the fourth embodiment.

Figure 5:
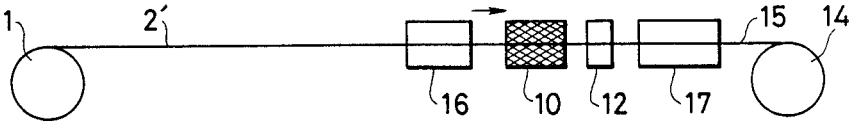
FIG. 5 is a diagram illustrating a method of producing steel wire according to a sixth embodiment of the invention.

FIG. 5 is a diagram illustrating the sixth embodiment. In FIG. 5, the steel wire 2' on which quenching and tempering have already been effected is strained under tension by the straining units 16 and 17. Under these conditions, it is heated at a temperature below the tempering temperature by the heating unit 10. Then, the steel wire 2' is rapidly cooled to room temperature in the cooling unit 12 and is finally wound on the wire wounding roll 14. It has been found that the steel wire 15 thus produced is excellent in sag resistance.

Figure 5A:
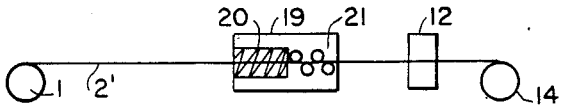
FIG. 5A is a diagram illustrating a modification of the method illustrated in FIG. 5.

In the embodiment as shown in FIG. 5, the cooling unit 12 is located before the straining unit 17. Alternatively, the unit 12 may be located behind the straining unit 17. The processes effected in this embodiment may be carried out either in tandem with or independently of the ordinary quenching and tempering processes. The sixth embodiment will hereinbelow be illustrated by Examples 9 and 10. It should be mentioned that in the fifth and sixth embodiments, if the heat treatment is effected under improper processing conditions, excessive strength may undesirably be rendered to the steel wire. Suitable conditions must thus be determined in such a manner as to yield no more than a predetermined strength. The sixth embodiment may be modified as shown in FIG. 5*a*. Straining during reheating may be by means of a bending roll similar to the second embodiment.

In the following Examples, "SAE 9254" is mainly employed as the steel wire. However, "SUP 6" and "SUP 7" can be employed as the steel wire. Furthermore, niobium (Nb) and/or vanadium (V) may be added to "SUP 6", "SUP 7" and "SAE 9254", respectively, as the steel wire employed in the present invention.

EXAMPLE 1

Details of the steel wire under test were as follows: "SAE 9254" (C: 0.56 wt %; Si: 1.37 wt %; Mn: 0.7 wt %; Cr: 0.59 wt %). Tempering was effected while straining the steel wire by means of a wire-drawing die acting as the processing unit 11. At this stage, the Austenitization temperature for quenching was 970° C. The tempering temperature was 465° C. The rate of reduction of area was 20%. The diameter of steel wire after the processing was 9.5 mm$^{\Phi}$. The tensile strength after processing was 185 kg/mm$^2$.

A static test was effected on a coil spring made from the steel wire thus produced with respect to sag resistance. For comparison, two test coil springs were provided, which were made from steel wires "SAE 9254" and "SAE 7", both of 9.5 mm$^{\Phi}$ in diameter. It is to be noted that conventional quenching and tempering (no processing involved) were effected on these steel wires so that they both had a strength of 185 kg/mm$^2$.

Both helical springs had the following factors:

| | |
|---|---|
| Diameter of steel wire | 9.5 mm$^{\Phi}$ |
| Diameter | 60 mm$^{\Phi}$ |
| Free mean coil height | 260 mm |
| Number of active coils | 4.25 |
| Total number of effective coils | 6.25 |

After pre-setting under a stress of 120 kg/mm$^2$, a constant load is placed on each spring for 100 hours so as to provide a clamping stress of 115 kg/mm$^2$. Under these conditions, the springs were tested at room temperature; the test results are shown in Table 1:

TABLE 1

| | Tested Springs | Procedure | Residual Shear Strain |
|---|---|---|---|
| A | SAE 9254 | The Invention | $1.5 \times 10^{-4}$ |
| B | SAE 9254 | Conventional Process | $2.9 \times 10^{-4}$ |
| C | SUP 7 | Conventional Process | $2.7 \times 10^{-4}$ |

EXAMPLE 2

A steel wire "SAE 9254" was utilized as in Example 1. Processing was carried out by means of a bending roll acting as the processing unit. At the same time, strain was imposed to the steel wire and tempering effected. The Austenitization temperature for quenching was 970° C. The tempering temperature was 435° C. The value of maximum bending strain was 2.7%. The diameter of the steel wire was 9.5 mm$^{\Phi}$. The tensile strength was 200 kg/mm$^2$.

A spring was made from this steel wire as in Example 1 and a test carried out at room temperature. For comparison, there were provided steel wires "SAE 9254" and "SUP 7", both of 9.5 mm$^{\Phi}$ in diameter on which conventional quenching and tempering were effected so as to provide a tensile strength of 200 kg/mm. Further, coil springs were made from the respective steel wires. After pre-setting under a stress of 125 kg/mm$^2$ thereto, a constant load was placed on each spring for 100 hours so as to provide a test stress of 115 kg/mm$^2$. The test results were shown in Table 2:

TABLE 2

| | Tested Springs | Procesure | Residual Shear Strain |
|---|---|---|---|
| D | SAE 9254 | The Invention | $0.8 \times 10^{-4}$ |
| E | SAE 9254 | Conventional Process | $1.9 \times 10^{-4}$ |
| C | SUP 7 | Conventional Process | $1.9 \times 10^{-4}$ |

As is clear in Table 2, the inventive spring was twice better than the test springs with respect to sag resistance.

EXAMPLE 3

The steel wire tested in Example 3 was the same as the one used in Example 2. As in FIG. 2, tempering was effected while straining the steel wire by means of a bending roll which acted as the processing unit 11 acting in both vertical and transverse directions. At this stage, the Austenitization temperature for quenching was 970° C. The tempering temperature was 465° C. The values of maximum bending strain were 0.4%, 1.2% and 2.1%. The diameter of the steel wire after processing was 9.5 mm$^{\Phi}$. The tensile strength was 200 kg/mm$^2$. The mechanical properties of this steel wire were first examined. The results of tensile tests are shown in FIG. 6.

Figure 6:
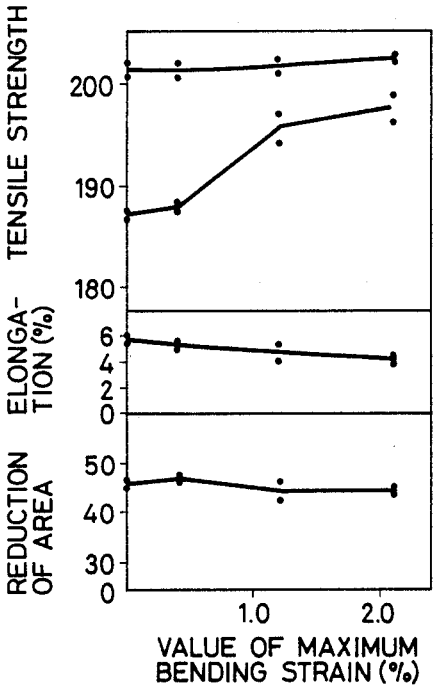
FIG. 6 is a graph showing relations of elongation, reduction of area, $\sigma_{max}$ and $\tau_{0.2}$, respectively, against values of maximum bending strain.

As is clear in FIG. 6, the values of elongation and reduction of area are barely changed as the value of maximum bending strain increases. Further, $\sigma_{0.2}$ drastically increases while $\sigma_{max}$ barely changes as the value of maximum bending strain increases.

Next, a coil spring was made from this steel wire and a static test carried out with respect to sag resistance. The conventional quenching and tempering (no processing involved) were effected on the same steel wire "SAE 9254" and "SUP 7" both of 9.5 mm$^{\Phi}$ in diameter so as to impose a tensile strength of 185 kg/mm$^2$ and a coil spring having the same factors as in Example 1 was made from this steel wire.

Figure 7:
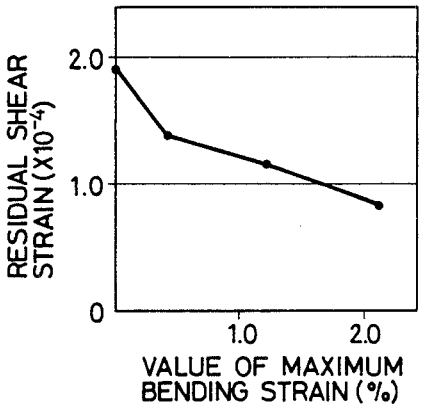
FIG. 7 is a graph showing various values of maximum bending strain in relation to residual shear strain.

After pre-setting under a stress of 120 kg/mm$^2$ thereto, constant load was placed on each spring for 100 hours so as to provide a stress test of 115 kg/mm$^2$. The test results are shown in FIG. 7. In FIG. 7, the horizontal axis shows the value of maximum bending strain and the vertical axis shows residual shear strain. As the value of maximum bending strain increases, the residual shear strain drastically decreases, resulting in an increase in sag resistance.

As is clear from the preceding embodiments, according to method of the present invention, a highly sag-resistant steel wire for a spring may be produced without increasing its strength, while not using expensive alloying elements, for example, Nb and V, for use in the manufacture of the wire.

Further, the steel wire according to the embodiments of the invention may be used in producing a suspension spring for use in connection with an automotive vehicle, contributing to a reduction in weight thereof.

EXAMPLE 4

The steel wire of this example was the same as used in the preceding embodiments.

Tempering was effected while inducing plastic strain by means of a drawing die acting as the processing unit 11, reducing the value of reduction of area. At this stage, the Austenitization temperature for quenching was 950° to 1000° C. The tempering temperature was 380° to 470° C. The values of reduction of area were 5%, 10%, 15% and 20%. The diameter of the steel wire after processing was 9.5 mm$^{\Phi}$. The tensile strength of the steel wire after processing was 185 kg/mm$^2$. A static test was made on a coil spring made from this steel wire with respect to sag resistance. For comparison, two test springs were made respectively from steel wires "SAE 9254" and "SUP 7" which were given a tensile strength of 185 kg/mm$^2$ in the course of the conventional quenching and tempering (no processing involved). The coil spring had the same factors as in the preceding embodiments.

After pre-setting under a stress of 120 kg/mm$^2$, a constant load was placed on each spring for 100 hours so as to provide a test stress of 115 kg/mm$^2$. A test was carried out at room temperature, the results of which are shown in FIG. 8.

Figure 8:
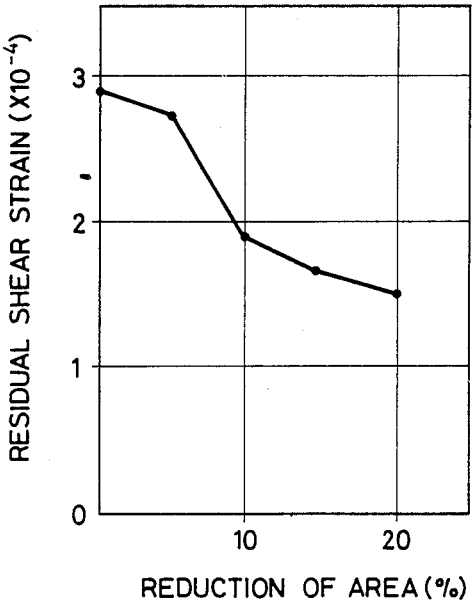
FIG. 8 is a graph showing the rate of reduction of area in relation to residual shear strain.

In FIG. 8, the horizontal axis shows the value of reduction of area due to processing and the vertical axis shows residual shear strain. As is clear from FIG. 8, even if the tensile strength is the same when the value of reduction of area is in excess of 10%, the residual Shear Strain remarkably decreases, increasing the sag resistance.

As is clear from the foregoing, by inducing plastic strain by means of a die or a roller die so as to reduce the value of reduction of area by not less than 10% either simultaneously with tempering or immediately after tempering is effected, a highly sag-resistant, steel wire may be produced without increasing its strength or using expensive alloying elements for use in the manufacture of the wire. Further, the steel wire of this invention may be used in the production of a suspension spring for use in an automotive vehicle, contributing to a reduction in weight thereof.

EXAMPLE 5

Figure 3:
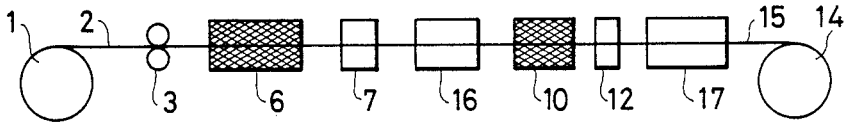
FIG. 3 is a diagram illustrating a method of producing steel wire according to a fourth embodiment of the invention.
Figure 9:
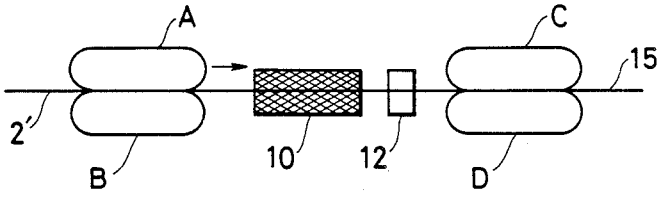
FIGS. 9 and 10 are diagrammatic views showing fourth and sixth embodiments of the present invention.

In FIG. 3, there are provided two pairs of caterpillars which are in contact with the tensile strain rendering units 16 and 17 under pressure and rotate in the same direction. One pair of caterpillars at the outlet side was driven at a circumferential speed faster than the other pair of caterpillars at the inlet side. An example of an appropriate arrangement is shown in FIG. 9. The steel wire 2 was nipped between the caterpillars A and B at the inlet side for holding purposes. In this manner, when tension was applied to the steel wire 2 in the direction of the arrow, it was prevented from sliding. The caterpillars C and D were rotated faster than the caterpillars A and B, whereby tensile stress was applied to the steel wire 2 between the caterpillars A and B and the caterpillars C and D. The steel wire 2 was heated to a tempering temperature by means of the heating unit 10 and then cooled to room temperature in the cooling unit 12 between the caterpillars A and B and the caterpillars C and D. Tempering was then effected while applying tensile strain to a steel wire "SAE 9254" as used in the preceding Examples. At this stage, the Austenitization temperature for quenching was 970° C. The tempering temperature was 435° C. The value of tensile strain were 1.2%, 2.5% and 3.2%. The tensile strength of the steel wire after the heat treatment was approximately 200 kg/mm$^2$.

A static test was performed on a coil spring made from the steel wire thus produced, with respect to sag resistance. For comparison, two test springs were made respectively from steel wires "SAE 9254" and "SUP 7" which were imparted tensile strengths of 200 kg/mm$^2$ in the course of conventional quenching and tempering. The coil spring had the same factors as in the preceding Example.

After pre-setting under a stress of 125 kg/mm$^2$, a constant load was placed on each spring for 100 hours so as to provide a test stress of 120 kg/mm$^2$. A test was carried out at room temperature, the results of which are shown in Table 3.

TABLE 3

| Tested Springs | Procedure | Residual Shear Strain |
|---|---|---|
| SAE 9254 A (Value of Tensil Strain = 1.2%) | The Invention | $1.1 \times 10^{-4}$ |
| SAE 9254 B (Value of Tensil Strain = 2.5%) | The Invention | $0.8 \times 10^{-4}$ |
| SAE 9254 C (Value of Tensil Strain = 3.2%) | The Invention | $0.6 \times 10^{-4}$ |
| SAE 9254 | Conventional Process | $1.9 \times 10^{-4}$ |
| SUP 7 | Conventional Process | $1.9 \times 10^{-4}$ |

As is shown in Table 3, it was found that the steel wire of the embodiment was more excellent in sag resistance than any conventional steel wire.

EXAMPLE 6

Figure 10:
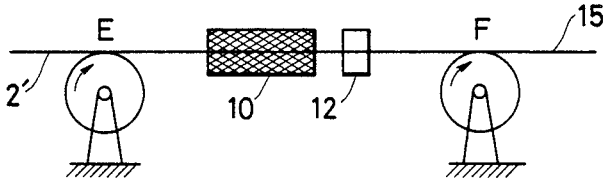

Two capstans were employed as the tensile strain rendering units 16 and 17. The capstan at the outlet side was driven for rotation at a circumferential speed faster than the other capstan. A suitable arrangement is shown in FIG. 10. The capstan F was rotated faster than the capstan E, whereby tensile strain was imposed to the steel wire between the capstans E and F. The steel wire was heated to a tempering temperature by means of the heating unit 10 and then cooled to room temperature in the cooling unit 12 therebetween. Tempering was effected while imposing a tensile strain to the steel wire "SAE 9254". At this stage, the Austenitization temperature for quenching was 970° C. The tempering temperature was 465° C. The resulting tensile strains were 1.2%, 2.5% and 3.2%. The tensile strength of the steel wire after the heat treatment is effect was approximately 185 kg/mm$^2$.

A test with respect to sag resistance was conducted on a coil spring made from this steel string at room temperature. The coil spring has the same factors as the one used in Example 1. For comparison, two test coil springs were made respectively from the steel wires "SAE 9254" and "SUP 7", which were given a tensile strength of 185 kg/mm$^2$ in the course of conventional quenching and tempering. After pre-setting a stress of 125 kg/mm$^2$ thereto, a constant load was placed on each spring for 100 hours so as to provide a test stress of 120 kg/mm$^2$. A test with respect to sag resistance was carried out at room temperature, the results of which are shown in Table 4.

TABLE 4

| Tested Springs | Procedure | Residual Shear Strain |
|---|---|---|
| SAE 9254 A (Value of Tensile Strain = 1.2%) | The Invention | $2.1 \times 10^{-4}$ |
| SAE 9254 B (Value of Tensile Strain = 2.5%) | The Invention | $1.8 \times 10^{-4}$ |
| SAE 9254 C (Value of Tensile Strain = 3.2%) | The Invention | $1.4 \times 10^{-4}$ |
| SAE 9254 | Conventional | $2.9 \times 10^{-4}$ |

TABLE 4-continued

| Tested Springs | Procedure | Residual Shear Strain |
|---|---|---|
| SUP 7 | Process Conventional Process | $2.7 \times 10^{-4}$ |

As is shown in Table 4, it was found that the wires of the invention were remarkably superior to the test springs with respect to sag resistance. As is clear from the foregoing Examples, a highly sag-resistant steel wire may be produced without increasing its strength, nor using an expensive alloying elements. It was found that the steel wire of the present invention may be used in producing a suspension spring for use in an automotive vehicle, contributing to a reduction in weight thereof.

EXAMPLE 7

A steel wire "SAE 9254" was used as a material under test.

Figure 4:
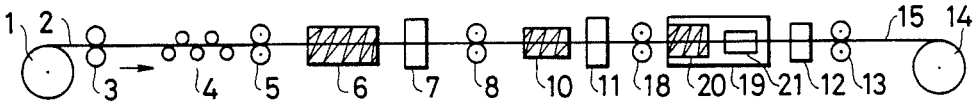
FIG. 4 is a diagram illustrating a method of producing steel wire according to a fifth embodiment of the invention.

In FIG. 4, the wire drawing die was employed as the processing unit 21. Upon straining, the Austenitization temperature for quenching was 970° C. The tempering temperature was 465° C. The value of reduction of area was 20%. The heating temperature at the time of processing was 450° C. The diameter of the steel wire after the processing was completed was 9.5 mm$^{\Phi}$. the tensile strength of the steel wire after the processing was completed was 185 kg/mm$^2$. A static test with respect to sag resistance was made on a coil spring made from the steel wire thus produced. For comparison, two test coil springs were made respectively from steel wires."SAE 9254" and "SUP 7", which were given a tensile strength of 185 kg/mm$^2$ in the course of conventional quenching and tempering.

After pre-setting a stress of 120 kg/mm$^2$ thereto, a constant load was placed on the respective springs for 100 hours so as to provide a test stress of 115 kg/mm$^2$. A test was carried out at room temperature, the results of which are shown in Table 5.

TABLE 5

| | Texted Springs | Procedure | Residual Shear Strain |
|---|---|---|---|
| A | SAE 9254 | The Invention | $1.6 \times 10^{-4}$ |
| B | SAE 9254 | Conventional Process | $2.9 \times 10^{-4}$ |
| C | SUP 7 | Conventional Process | $2.7 \times 10^{-4}$ |

As is shown in Table 5, it was demonstrated that the steel wire according to the invention was superior to the prior art steel wires with respect to sag resistance.

EXAMPLE 8

A steel wire "SUP 7" was used as the material under test as in Example 7. A bending roll was employed as the processing unit for straining purposes.

Upon straining, the Austenitization temperature for quenching was 970° C. The tempering temperature was 435° C., the value of maximum bending strain was 2.1%. The heating temperature at the time of processing was 410° C. The diameter and tensile strength of the steel wire after processing were 9.5 mm$^{\Phi}$ and 200 kg/mm$^2$, respectively.

A test with respect to sag resistance was made on a coil spring made from this steel wire. The coil spring had the same factors as the one used in Example 7.

For comparison, two test coil springs were made from the steel wire "SAE 9254" and "SUP 7", both of 9.5 mm$^{\Phi}$ in diameter, which were imposed a tensile strength of 200 kg/mm$^2$ in the course of the conventional quenching and tempering. After pre-setting a stress of 125 kg/mm$^2$ thereto, a constant load was successively placed on the respective springs for 100 hours so as to provide a test stress of 115 kg/mm$^2$. A test was carried out at room temperature, the results of which are shown in Table 6.

TABLE 6

| | Tested Springs | Procedure | Residual Shear Strain |
|---|---|---|---|
| D | SUP 7 | The Invention | $0.9 \times 10^{-4}$ |
| E | SEA 9254 | Conventional Process | $1.9 \times 10^{-4}$ |
| F | SUP 7 | Conventional Process | $1.9 \times 10^{-4}$ |

As is shown in Table 6, the steel wire of the embodiment was twice or more better than the prior art steel wires with respect to sag resistance.

EXAMPLE 9

With reference to FIG. 5, after quenching and tempering processes were completed, caterpillars were used for straining purposes. The caterpillars were the same as shown in FIG. 9.

That is, two pairs of caterpillars were in contact with the tensile strain bending units 10 and 17 under pressure and rotated in the same direction. One pair of caterpillars at the outlet side was driven at a circumferential speed faster than the other pair of caterpillars at the inlet side. The steel wire 2' was nipped between the caterpillars A and B at the inlet side for holding purposes. In this manner, when tension was applied to the steel wire 2' in the direction of the arrow, it was prevented from sliding. The caterpillars C and D were rotated faster than the caterpillars A and B, whereby tensile stress was applied to the steel wire 2' between the caterpillars A and B and the caterpillars C and D. The steel wire 2' was heated to a tempering temperature by means of the heating unit 10 and then cooled to room temperature in the cooling unit 12. An oil tempered wire "SAE 9254" of 200 kg/mm$^2$ in tensile strength (0.56 wt % C, 1.37 wt % Si, 0.70 wt % Mn, 0.59 wt % Cr) was used as the material under test. Tempering was effected thereon while imposing tensile strain thereto. Further, the values of tensile stress given are 1.2%, 2.5% and 3.2%.

A static test was made on a coil spring made from the steel wire thus produced. For comparison, two test coil springs were made respectively from the steel wire "SAE 9254" and "SUP 7", which had a tensile strength of 200 kg/mm$^2$. The factors of the coil springs were the same as above. After pre-setting a stress of 125 kg/mm$^2$ thereto, a constant load was placed on the respective springs for 100 hours in a successive manner so as to provide a test stress of 120 kg/mm$^2$. A test with respect to sag resistance was effected at room temperature, the results of which are shown in Table 7.

TABLE 7

| Tested Springs | Procedure | Residual Shear Strain |
|---|---|---|
| SAE 9254 A (Value of Tensile Strain = 1.2%) | The Invention | $1.2 \times 10^{-4}$ |
| SAE 9254 B (Value of Tensile Strain = 2.5%) | The Invention | $0.7 \times 10^{-4}$ |

TABLE 7-continued

| Tested Springs | Procedure | Residual Shear Strain |
|---|---|---|
| SAE 9254 C (Value of Tensile Strain = 3.2%) | The Invention | $0.6 \times 10^{-4}$ |
| SAE 9254 | Conventional Process | $1.9 \times 10^{-4}$ |
| SUP 7 | Conventional Process | $1.9 \times 10^{-4}$ |

As is shown in Table 7, the steel wire according to the embodiment was highly superior to the prior art steel wires with respect to sag resistance.

EXAMPLE 10

Two capstans, as in FIG. 10, were employed as the tensile strain imposing units 16 and 17. The capstan at the outlet side were driven for rotation at a circumferential speed faster than the capstan at the inlet side. The capstan F was rotated faster than the capstan E, whereby tensile strain was applied to the steel wire between the capstans E and F. The steel wire was heated to a tempering temperature by means of the heating unit 10 and then cooled to room temperature in the cooling unit 12 therebetween. The above processing was effected while imposing tensile strain to the steel wire "SAE 9254" as in Example 9 of 185 kg/mm$^2$ by means of the above units. The rates of tensile strain given were 1.2%, 2.5% and 3.2%.

A test was made on a coil spring made from this steel wire at room temperature. The coil spring had the same factors as the one used in Example 9. For comparison, two test coil springs were made respectively from the steel wire "SAE 9254" and "SUP 7", which were imposed a tensile strength of 185 kg/mm$^2$. After pre-setting a stress of 125 kg/mm$^2$ thereto, a constant load was successively placed on the respective springs for 100 hours so as to provide a test stress of 120 kg/mm$^2$. A test was carried out at room temperature, the results of which are shown in Table 8.

TABLE 8

| Tested Springs | Procedure | Residual Shear Strain |
|---|---|---|
| SAE 9254 A (Value of Tensile Strain = 1.2%) | The Invention | $2.2 \times 10^{-4}$ |
| SAE 9254 B (Value of Tensile Strain = 2.5%) | The Invention | $1.8 \times 10^{-4}$ |
| SAE 9254 C (Value of Tensile Strain = 3.2%) | The Invention | $1.5 \times 10^{-4}$ |
| SAE 9254 | Conventional Process | $2.9 \times 10^{-4}$ |
| SUP 7 | Conventional Process | $2.7 \times 10^{-4}$ |

As shown in Table 8, the steel wire of the present invention was remarkably superior to the prior art steel wires with respect to sag resistance.

As is clear from the preceding Examples, a high sag-resistant steel wire may be produced without increasing its strength nor using an expensive alloying elements such as used in the manufacture of an oil tempered wire. Further, the steel wire of this invention may be used in producing a suspension spring for use in automotive vehicles, contributing to a reduction in weight thereof.

In the preceding embodiments, carbon is a necessary constituent for imposing strength to the steel wire for the spring. In general, the higher the strength, the higher the sag resistance. In order to render high strength thereto and thereby to improve the sag resistance, the content of carbon is preferably 0.5 to 0.7%. If less than 0.5%, a sufficient strength is not obtained, whereas if more than 0.7%, the toughness decreases.

Further, according to the present invention, desirable results may be obtained when cold straining is effected after quenching and tempering processes are complete.

What is claimed is:

1. A coil spring having reduced residual shear strain and increased sag resistance, produced by a process in which the improvement comprises: straining a steel wire along a lengthwise direction of said wire to improve sag resistance of said coil spring, said strain being applied by imposing a tensile strain to said steel wire without permanently changing the shape thereof, said tensile strain being imposed following quenching and tempering, and said wire having a content of carbon of 0.5 to 0.7 wt %, so as to reduce the residual shear strain of said wire by at least 20% as compared with residual shear strain of a wire produced by quenching and tempering only, and forming said coil spring from said wire.

2. A coil spring having reduced residual shear strain and increased sag resistance, produced by a process in which the improvement comprises: straining a steel wire along a lenghtwise direction of said wire to improve sag resistance of said coil spring, said strain being applied by imposing strain to said steel wire by using a bending roll without permanently changing the shape of said wire, said strain being imposed following quenching and tempering, and said wire having a content of carbon of 0.5 to 0.7 wt %, so as to reduce the residual shear strain of said wire by at least 20% as compared with the residual shear strain of a wire produced by quenching and tempering only, and forming said coil spring from said wire.

3. A method of producing a coil spring having increased sag resistance, wherein the improvement comprises: straining a steel wire along a lengthwise direction of said wire to improve sag resistance of said coil spring, said strain being applied by, after quenching said steel wire, tempering said wire at 400° to 465° C. while imposing tensile strain thereto without permanently changing the form thereof, said wire having a carbon content of 0.5 to 0.7 wt %, and forming said coil spring from said wire.

4. A method of producing a coil spring having increased sag resistance, wherein the improvement comprises: straining a steel wire along a lengthwise direction of said wire to improve sag resistance of said wire when formed into said coil spring, said strain being applied by, after quenching said steel wire, tempering said wire at 400° to 465° C. while imposing strain thereto by using a bending roll without permanently changing the form of said wire, said wire having a carbon content of 0.5 to 0.7 wt %, and forming said coil spring from said wire.

5. A method of producing a coil spring having increased sag resistance, wherein the improvement comprises: straining a steel wire along a lengthwise direction of said wire to improve sag resistance of said coil spring, said strain being applied by, after quenching said steel wire, tempering said wire at 400° to 465° C. while imposing strain thereto by plastic working by using dies or roller dies with at least 10% reduction of area, said wire having a content of carbon of 0.5 to 0.7 wt %, and forming said coil spring from said wire.

6. A method of producing a coil spring having increased sag resistance, wherein the improvement comprises: straining a steel wire along a lengthwise direction of said wire to improve sag resistance of said coil spring, said strain being applied by, after quenching said steel wire, tempering said wire at 400° to 465° C. while imposing strain thereto by effecting at least one of plastic working and reforming with at least 10% reduction of area, said wire having a content of carbon of 0.5 to 0.7 wt %, and forming said coil spring from said wire.

7. A method of producing a coil spring having increased sag resistance, wherein the improvement comprises: straining a steel wire along a lengthwise direction of said wire to improve sag resistance of said coil spring, said strain being applied by, after quenching said steel wire, tampering said wire at 400° to 465° C. while imposing tensile strain thereto, said wire having a content of carbon of 0.5 to 0.7 wt %, and forming said coil spring from said wire.

8. A method of producing a coil spring having increased sag resistance, wherein the improvement comprises: straining a steel wire along a lengthwise direction of said wire to improve sag resistance of said coil spring, said strain being applied by, after quenching said steel wire, tempering said wire at 400° to 465° C. while imposing strain thereto by using a bending roll, said wire having a content of carbon of 0.5 to 0.7 wt %, and forming said coil spring from said wire.

9. A coil spring having reduced shear strain and increased sag resistance, produced by a process wherein the improvement comprises: straining a steel wire along a lengthwise direction of said wire to improve sag resistance of said coil spring, said strain being applied by, after quenching a steel wire and tempering said wire at 400° to 465° C., heating said wire to not more than tempering temperature while effecting at least one of plastic working and reforming to said wire at not more than a tempering temperature so as to strain said wire by at least 10%, and thereafter cooling said wire to room temperature, said wire having a content of carbon of 0.5 to 0.7 wt %, and forming said coil spring from said wire.

10. A coil spring having reduced residual shear strain and increased sag resistance, produced by a process in which the improvement comprises: straining a steel wire along a lengthwise direction of said wire to improve sag resistance of said coil spring, said strain being applied by imposing strain to said steel wire by effecting at least one of plastic working and reforming with at least a 10% reduction of area, said strain being imposed following quenching and tempering, and said wire having a content of carbon of 0.5 to 0.76 wt %, so as to reduce the residual shear strain of said wire by at least 20%, as compared with residual shear strain of a wire produced by quenching and tempering only, and forming said coil spring from said wire.

11. A method of producing a coil spring having increased sag resistance, wherein the improvement comprises: straining a steel wire along a lengthwise direction of said wire to improve sag resistance of said coil spring, said strain being applied by, after quenching said steel wire, tempering said wire at 400° to 465° C. while imposing strain thereto, without permanently changing the form thereof, by means of at least one of tension and a bending roll, and thereafter cold coiling said wire, said wire having a carbon content of 0.5 to 0.7 wt %, and forming said coil spring from said wire.

12. A coil spring having increased sag resistance, produced by a process in which the improvement comprises: straining a steel wire along a lengthwise direction of said wire to improve sag resistance of said coil spring, said strain being applied by imposing strain to said steel wire without permanently changing the shape thereof, said strain being imposed by means of at least one of tension and a bending roll following quenching and tempering, and said wire having a content of carbon of 0.5 to 0.7 wt %, so as to reduce the residual sheara strain of said wire by at least 20% as compared with residual shear strain of a wire produced by quenching and tempering only, forming said coil spring from said wire.

13. A coil spring having increased sag resistance, produced by a process wherein the improvement comprises: straining a steel wire along a lengthwise direction of said wire to improve sag resistance of said coil spring, said strain being applied by, after quenching said steel wire and tempering said wire at 400° to 465° C., heating said wire to not more than a tempering temperature while effecting tensile straining to said wire at not more than a tempering temperature, said straining being imposed to said wire without permanently changing the form thereof, and thereafter cooling said wire to room temperature, said wire having a content of carbon of 0.5 to 0.7 wt %, and forming said coil spring from said wire.

14. A coil spring having increased sag resistance, produced by a process wherein the improvement comprises: straining a steel wire along a lengthwise direction of said wire to improve sag resistance of said coil spring, said strain being applied by, after quenching said steel wire and tempering said wire at 400° to 465° C., heating said wire to not more than a tempering temperature while effecting straining thereto at not more than a tempering temperature, said straining being imposed to said wire without permanently changing the shape thereof by using a bending roll, and thereafter cooling said wire to room temperature, said wire having a content of carbon of 0.5 to 0.7 wt %, and forming said coil spring from said wire.

15. A coil spring having increased sag resistance, produced by a process wherein the improvement comprises: straining a steel wire along a lengthwise direction of said wire to improve sag resistance of said coil spring, said strain being applied by, after quenching said steel wire and tempering said wire at 400° to 465° C., heating said wire to not more than a tempering temperature while effecting straining thereto at not more than a tempering temperature, said straining being imposed to said wire without permanently changing the shape thereof by using at least one of tension and a bending roll, and thereafter cooling said wire to room temperature, said wire having a content of carbon of 0.5 to 0.7 wt %, and forming said coil spring from said wire.

* * * * *